United States Patent [19]

Tamura

[11] Patent Number: 4,692,018

[45] Date of Patent: Sep. 8, 1987

[54] CARTRIDGE-TYPE APPARATUS FOR EXCHANGING A DEVELOPING DEVICE AND TONER SUPPLY CONTAINER

[75] Inventor: Takashi Tamura, Higashimine, Japan

[73] Assignee: Konishiroku Photo Industry Co., Ltd., Tokyo, Japan

[21] Appl. No.: 772,251

[22] Filed: Sep. 3, 1985

[30] Foreign Application Priority Data

Sep. 10, 1984 [JP] Japan ..... 59-189061

[51] Int. Cl.[4] ..... G03G 21/00

[52] U.S. Cl. ..... 355/3 R; 206/216; 206/316; 206/523; 220/4 E; 355/300; 355/21

[58] Field of Search ..... 355/3 R, 3 DD, 21; 206/216, 316, 523, 524; 220/4 B, 4 E, 23.2

[56] References Cited

U.S. PATENT DOCUMENTS

| | | | |
|---|---|---|---|
| 3,594,082 | 7/1971 | Lonchar | 206/316 X |
| 3,836,925 | 9/1974 | Steponaitis | 206/316 X |
| 4,432,632 | 2/1984 | Yokota | 355/3 DD |
| 4,456,362 | 6/1984 | Masaki et al. | 355/3 R |
| 4,460,267 | 7/1984 | Ogawa | 355/3 DD |
| 4,465,359 | 8/1984 | Nakahata | 355/3 R |
| 4,530,588 | 7/1985 | Kimura et al. | 355/3 DD X |

FOREIGN PATENT DOCUMENTS

| | | | |
|---|---|---|---|
| 3040915 | 6/1982 | Fed. Rep. of Germany | 206/316 |

*Primary Examiner*—Fred L. Braun

*Attorney, Agent, or Firm*—Frishauf, Holtz, Goodman & Woodward

[57] ABSTRACT

A cartridge-type parts exchange assembly for an image recording device includes a cartridge housing made up of a pair of hingedly connected hollow vessels. One of the vessels removably contains a developing device for the image recording apparatus, and the other of the vessels removably contains a toner supply container for the image recording apparatus. The hingedly connected vessels are normally in a closed position. When the developing device and toner supply container are to be installed in an image recording apparatus, the vessels are pivotally opened by rotation about the hinge so that open ends of the vessels are exposed for sliding out of the respective developing device and toner supply container.

11 Claims, 2 Drawing Figures

CARTRIDGE-TYPE APPARATUS FOR EXCHANGING A DEVELOPING DEVICE AND TONER SUPPLY CONTAINER

BACKGROUND OF THE INVENTION

The present invention relates to recording equipment such as an electrophotographic copying machine, and particularly to an exchange apparatus for selectively attaching a developing device and a toner supply container, which are expendable supplies, to such a machine.

As is generally known, in an image processing part of recording equipment such as electrophotographic copying machines, there are instances where a toner supply contained and a developing device need to be exchanged for new ones, in order to vary a color process or to change expendable supplies, Up to now, in such a case, when a toner supply container and a developing device to be removed are exchanged, new ones are separately taken out from respective packages. However, with such an apparatus for exchanging exchangeable parts, there is a fear that toner may be spilled and soil hands or the surroundings, before the toner supply container and developing devices taken out of each package are attached to the machine.

Accordingly, a structure has been proposed such that three parts including an image holding drum, a toner supply container and a developing device are set up in an exchange cartridge, and these parts are exchanged together with the exchange cartridge.

However, this structure is not economical because whenever a toner supply container and a developing device are exchanged, an image holding drum and other parts which are durable parts are also exchanged. This cartridge structure comprising these three parts also brings about a waste of resources because, for example, when toner in its supply container has run out, other parts must be scrapped even if they are not worn out.

OBJECTS AND SUMMARY OF THE INVENTION

Considering the above-mentioned problems in a conventional apparatus for exchanging parts of a copying machine or the like, the object of the present invention is to provide an exchange apparatus having an excellent structure which enables exchange of a toner supply container and a developing device only, while preventing toner from soiling hands and the surroundings.

In order to achieve the object described above, the present invention proposes an apparatus for exchanging a developing device and other parts, where, among at least an image holding member (i.e., the image holding drum), a development device and a toner supply container all installed to be removable in a holding frame which is capable of being drawn out from a main body of a copying machine, the developing device and the toner supply container are each held in a respective vessel of a two-piece exchanging apparatus, the vessels being capable of rotating around a connection between the two pieces of the two-piece structure. When the exchanging apparatus is opened, said developing device and toner supply container are pressed forward toward the image holding member installed in the above-mentioned holding frame in the body of the copying machine. The developing device and toner supply container are stored facing each other in said vessels when the exchanging apparatus is closed.

DETAILED DESCRIPTION OF THE INVENTION

Figure 1:
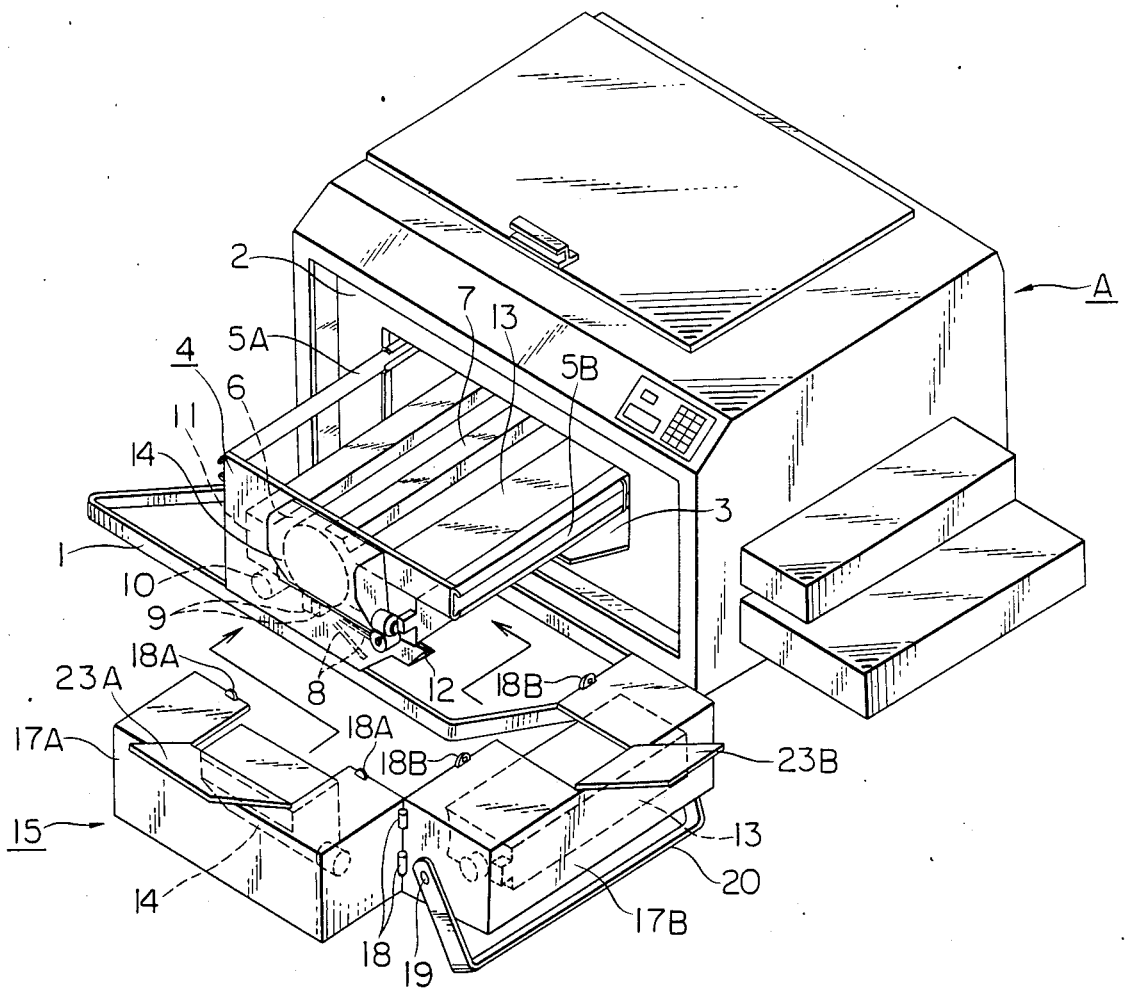
FIG. 1 is a perspective view showing a developing device and a toner supply device of a copying machine being exchanged, employing an exchanging apparatus of the present invention.

FIG. 1 shows a copying machine suitable for exchanging a developing device and the like, employing an exchanging apparatus of the present invention. In the embodiment of FIG. 1, a front door 1 of a copying machine A is opened and a holding frame 4 positioned in an opening 3 of a machine frame 2 is drawn out forwardly and horizontally. Namely, the holding frame 4 can be drawn out forwardly through the opening 3 of the machine frame 2, along guiding rails 5A and 5B which are installed horizontally on the inside of the machine frame 2. The holding frame 4 holds on the inside thereof an image holding drum 6, a charging electrode 7, a paper supplier guiding plate, a transference-separation pole 9, a conveyor roller 10 and a cleaning device 11, which are all arranged in the direction of rotation of the image holding drum 6 as an image holding member. On the bottom of said holding frame 4, a developing device 13 is removably attached along a guiding groove 12, and a toner supply container 14 containing toner is removably attached on the outside of said holding frame 4.

Figure 2:
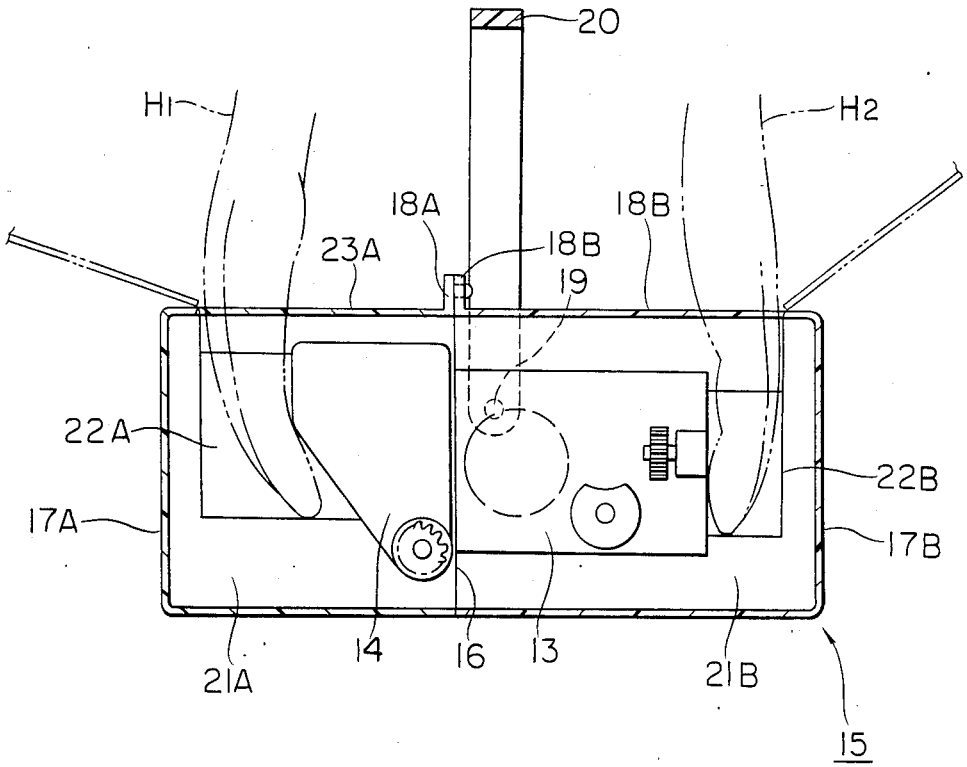
FIG. 2 is a part-sectional view of an exchanging apparatus of the present invention in a closed state.

The developing device 13 and toner supply container 14 are contained in a portable cartridge 15, which is shown in FIG. 2 in detail. Cartridge 15 is capable of being divided into two and is easy to carry. FIG. 2 shows cartridge 15 in its closed state. The portable cartridge 15 is divided into two and is made of a plastic rectangular box. As shown in FIG. 2, cartridge 15 comprises two vessels or portions 17A, 17B which face each other at their opening portions with a division line 16 as a boundary therebetween. Vessels 17A, 17B are connected together by a thin hinge 18 (shown in FIG. 1) which is made as one body with at least one of said vessels. Moreover, at openings on the upper side of the vessels 17A, 17B, two pairs of elastic clips 18A, 18B are integrally made as one body with the respective vessels, so that the vessels 17A and 17B can be kept closed, as FIG. 2 shows, by engaging the elastic clips 18A, 18B. One of the vessels 17A and 17B has a rectractable handle 20 which can rotate around a support pin 19. The portable cartridge 15 can be carried by this handle 20.

The vessels 17A and 17B contain holding blocks 21A and 21B made of styrofoam or the like, which in turn contain and hold the toner supply container 14 and the developing device 13 adjacent to respective openings of the vessels 17A and 17B in a way that they can glide (i.e., slide) to be taken out. Holding blocks 21A and 21B are employed for protecting the contents from outer impacts. On the inside of the vessels 17A and 17B, guiding projections or guiding grooves or the like are provided so that the contained devices can glide (i.e., slide) to be taken out. The developing device 13 and the toner supply container 14 contained in the vessels 17A and 17B, respectively, have a structure such that their parts bearing developer are facing each other when the toner supply container 14 is closed, so as to prevent toner from scattering around.

In order to enable the developing device 13 and the toner supply container 14 to glide out from the opened vessels 17A and 17B, spaces 22A and 22B are provided along the longitudinal direction of said developing device 13 and toner supply container 14, allowing access by the user's hands H1 and H2. Moreover, on each upper side of the vessels 17A and 17B above these spaces 22A and 22B, openable lids 23A and 22B are provided, as shown in FIG. 1. After opening the vessels 17A, 17B by pivoting around hinge 18, and after opening the lids 23A and 23B, one can take out the toner supply container 14 and the developing device 13 from the respective vessels 17A and 17B by pushing and sliding the toner supply container 14 and the developing device 13 on their back until they reach their operative positions on frame 4.

Since the embodiment illustrated by the drawings has the structure described above, one can exchange the toner supply container 14 and the developing device 13, after drawing out the holding frame 4 from the machine body A as FIG. 1 shows, by removing a used toner supply container 14 and developing device 13 from the holding frame 4 and facing the opened new portable cartrdige 15 to the holding frame 4 as FIG. 1 shows. Namely, by opening the vessels 17A and 17B of the portable cartridge 15 at a right angle to each other as FIG. 1 shows, the new toner supply container 14 and developing device 13 face the respective position at which they are to be installed. Therefore, keeping this position of the vessels 17A and 17B, one can install a new toner supply container 14 and developing device 13 to the holding frame 4, by inserting fingers into the spaces 22A and 22B which are accessed by opening the lids 23A and 23B, and then pushing out the toner supply container 14 and the developing device 13 on their back to the positions to which each of them should be attached.

In the embodiment described above, the portable cartridge 15 consists of the pivotally connected vessels 17A and 17B which can open and close horizontally. However, the present invention is not limited to this type, and other structures are possible such as to open and close vertically and so on. Moreover, though the described embodiment illustrated an example of applying the present invention to an electrophotographic copying machine, this invention can be applied also to other recording equipment.

It is apparent from the explanation given above that excellent effects of the present invention can be obtained by employing it in combination with a copying machine having an economical structure, because one can exchange only the needed expendable parts, namely, a toner supply container and a developing device, without soiling hands and the surroundings by toner and without unnecessarily replacing other parts which are not worn out. Moreover, the present invention is especially useful in carrying out color development. That is to say, one may achieve color development on one color by combining a toner supply container with a developing device both containing toner of the same desired color, and before performing color development of another color, one should only take out the previous toner supply container and developing device together with the portable cartridge and install another set of a toner supply container and a developing device. Thus, an apparatus of the invention for exchanging a developing device and other parts brings more excellent effects when it is employed in combination with a suitable color copying machine adapted for it.

I claim:

1. A cartridge-type parts exchange assembly for an image recording device, said cartridge-type parts exchange assembly removably containing at least a developing device and a toner supply container but not an image holding member, said developing device and said toner supply container being adapted to be removably installed in said image recording device, said parts exchange assembly comprising:

a cartridge housing including a pair of hollow vessels, said vessels each having an open end, one of said vessels removably containing said developing device and the other of said vessels removably containing said toner supply container;

hinge means pivotally connecting said vessels together so that said vessels are rotatable about said hinge means between a closed position whereat said open ends of said vessels face each other, and an open position whereat said open ends are accessible and do not face each other; and an openable lid provided on each of said vessels for selectively covering respective access openings of said vessels to permit access to the interior of said vessels when said lids are opened to permit a user to slide a respective developing device and a toner supply container out of a respective open end of its associated vessel when said vessels are in said open position, thereby facilitating installation of said developing device and said toner supply container in said image recording device.

2. A cartridge-type parts exchange assembly according to claim 1, wherein each of said vessels has an elongated configuration and said hinge means is provided perpendicularly to the direction of the elongation thereof.

3. A cartridge-type parts exchange assembly according to claim 1, wherein said cartridge housing comprises locking means on said vessels for locking said vessels in said closed position.

4. A cartridge-type parts exchange assembly according to claim 1, wherein said cartridge housing comprises handle means coupled thereto for carrying said cartridge housing.

5. A cartridge-type parts exchange assembly according to claim 4, wherein said handle means is pivotally coupled to said cartridge housing.

6. A cartridge-type parts exchange assembly according to claim 1, wherein said hollow vessels comprise impact absorbing means therein for mounting said respective developing device and toner supply container therein.

7. A cartridge-type parts exchange assembly according to claim 6, wherein said impact absorbing means comprises means for permitting said respective developing device and toner supply container to be slidable in and out of said respective vessel.

8. A cartridge-type parts exchange assembly according to claim 1, wherein said vessels each include slide means therein for slidably mounting said respective developing device and toner supply container to permit sliding out of said developing device and toner supply container from their associated vessels.

9. A cartridge-type parts exchange assembly according to claim 1, wherein said vessels are at a right angle to each other when in said open position.

10. A cartridge-type parts exchange assembly according to claim 1, wherein said image recording device comprises means for receiving said developing device and means for receiving said toner supply container, said open ends of said vessels being opposite said respective receiving means when said vessels are in said open position.

11. A cartridge-type parts exchange assembly according to claim 10, wherein said vessels are at a right angle to each other when in said open position.

* * * * *